United States Patent [19]

Poole

[11] Patent Number: 5,035,757

[45] Date of Patent: Jul. 30, 1991

[54] AZIDE-FREE GAS GENERANT COMPOSITION WITH EASILY FILTERABLE COMBUSTION PRODUCTS

[75] Inventor: Donald R. Poole, Woodinville, Wash.

[73] Assignee: Automotive Systems Laboratory, Inc., Farmington Hills, Mich.

[21] Appl. No.: 603,469

[22] Filed: Oct. 25, 1990

[51] Int. Cl.[5] ..... C06B 31/28

[52] U.S. Cl. ..... 149/46; 149/61; 149/76; 149/77; 149/45; 149/70; 149/75; 149/83; 149/85

[58] Field of Search ..... 149/46, 61, 76, 77, 149/45, 70, 75, 83, 85

[56] References Cited

U.S. PATENT DOCUMENTS

| | | | |
|---|---|---|---|
| 4,369,079 | 1/1983 | Shaw | 149/2 |
| 4,370,181 | 1/1983 | Lundstrom et al. | 149/2 |
| 4,865,667 | 9/1989 | Zevner et al. | 149/22 |
| 4,948,439 | 8/1990 | Poole et al. | 149/46 |

*Primary Examiner*—Stephen J. Lechert, Jr.
*Attorney, Agent, or Firm*—Lyon & Delevie

[57] ABSTRACT

A gas generant composition devoid of azides which yields solid combustion products which are easily filtered rendering the gases useful for inflating automobile occupant restraint bags.

15 Claims, No Drawings

AZIDE-FREE GAS GENERANT COMPOSITION WITH EASILY FILTERABLE COMBUSTION PRODUCTS

BACKGROUND OF THE INVENTION

1. Field of Invention

Gas generating compositions for inflating occupant restraint devices of over-the-road vehicles have been under development worldwide for many years and numerous patents have been granted thereon. Because of strict requirements relating to toxicity of the inflating gases, most gas generants now in use are based on inorganic azides, and especially sodium azide. One advantage of such known sodium azide gas generants is that the solid combustion products thereof generally produce a slag or "clinkers" which are easily filtered, resulting in a relatively clean gas. The ability of a gas generant to form a slag is a great advantage when the gases are used for inflation purposes, especially when the gases must be filtered as in the inflation of an automobile occupant restraint bag.

However, the use of sodium azide, or other azides as a practical matter, results in extra expense and risk in gas generant manufacture due to the extreme toxicity of unfired azides. In addition, the potential hazard and disposal problem of unfired inflation devices must be considered. Thus, a nonazide gas generant exhibits a significant advantage over an azide-based gas generant because of such toxicity related concerns.

A fundamental problem that must be solved when using nonazide based gas generants is that it is easier to formulate slagging gas generants based on sodium azide than nonazide types because the combustion temperature is relatively low with azide-based gas generants. For example, the combustion temperature of a sodium azide/iron oxide slagging type generant is 969° C. (1776° F.) whereas, nonazide slagging type generants heretofore known have exhibited a combustion temperature of 1818° C. (3304° F.). Moreover, many common solid combustion products which might be expected from nonazide gas generants are liquids at the combustion temperature exhibited and are therefore difficult to filter out of the gas stream. For example, potassium carbonate melts at 891° C. and sodium silicate melts at approximately 1100° C.

The formation of solid combustion products which coalesce at high combustion temperatures, and at high gas flow rates, requires a special combination of materials. Early attempts at formulating nonazide gas generants resulted in semi-solid combustion products that were difficult to filter. It has been found that combustion products which are liquid at the combustion temperature must be cooled until solidifed before filtering is successful because liquid products penetrate and clog the filter. It has also been found that cooling of the liquid combustion products results in cooling of the gas, which requires the use of more gas generant. A cooled gas is relatively less efficient for inflation purposes, especially with an aspirator system. The additional gas generant, in turn, requires more cooling and an additional filter as well as a larger combustion chamber.

The aforesaid problems are solved by the present invention, which discloses several types of nonazide gas generants that yield solid combustion products which form a slag or clinkers at the relatively high combustion temperatures encountered with nonazide gas generants. The gas generants disclosed herein allow the use of simple, relatively inexpensive filters which cool the gas less and result in better pumping in an aspirated system. Taken together, these factors result in a simpler, less expensive and smaller air bag inflation system.

2. Description of the Prior Art

An example of prior art teachings relating to the subject matter of the instant invention is found in European Patent No. 0-055-547 entitled "Solid Compositions for Generating Nitrogen, The Generation of Nitrogen Therefrom and Inflation of Gas Bags Therewith". This patent describes use of alkali or alkaline earth metal salts of a hydrogen-free tetrazole compound and oxidizers of sodium nitrate, sodium nitrite and potassium nitrate or alkaline earth nitrates. A filter design is disclosed which utilizes fiberglass fabric that forms a tacky surface for particle entrapment. The filter has regions which cool and condense combustion solids. It is obvious from the disclosure and from the nature of the gas generating compositions that the solids produced do not form a slag and are difficult to filter.

European Patent No. 0-055-904 entitled "Azide Free Compositions for Generating Nitrogen, The Generation of Nitrogen Therefrom and Inflation of Gas Bags Therewith" describes a filter used for particle entrapment. Oxidizers which contain no oxygen are used, and no mention of slag formation is made.

German Patent 2-004-620 teaches compositions of organic salts (aminoguanidine) of ditetrazole and azotetrazole that are oxidized using oxidizers such as barium nitrate or potassium nitrate. However, no compositions are mentioned which would lead to slag formation.

U.S. Pat. No. 3,947,300 entitled "Fuel for Generation of Nontoxic Propellant Gases" discloses the use of alkali or alkaline earth metal azides that can be oxidized by practically any stable anhydrous oxidizing agent. The ratio of ingredients is selected to assure the formation of glass-like silicates with "as low a melting or softening point as possible" (column 2, lines 62–63 and column 4, lines 67–68). These silicates would be very difficult to filter in a high temperature system.

U.S. Pat. No. 4,376,002 entitled "Multi-Ingredient Gas Generators" teaches the use of sodium azide and metal oxide ($Fe_2O_3$). The metal oxide functions as an oxidizer converting sodium azide to sodium oxide and nitrogen as shown in the following equations:

$$6\ NaN_3 + Fe_2O_3 \rightarrow 3\ Na_2O + 2\ Fe + 9\ N_2$$

or $$4\ NaN_3 + Fe_2O_3 \rightarrow 2\ Na_2O + Fe + FeO + 6\ N_2$$

The sodium oxide then reacts with the FeO forming sodium ferrite or with silicon dioxide (if present) to form sodium silicate or with aluminum oxide to form sodium aluminate, as shown below:

$$Na_2O + 2\ FeO \rightarrow 2\ Na\ FeO_2\ (MP = 1347°\ C.)$$

$$Na_2O = SiO_2 \rightarrow Na_2\ SiO_3\ (MP = 1088°\ C.)$$

or $$2\ Na_2O + SiO_2 \rightarrow Na_4\ SiO_4\ (MP = 1018°\ C.)$$

$$Na_2O + Al_2O_3 \rightarrow 2\ Na\ AlO_2\ (MP = 1650°\ C.)$$

However, the above reaction products melt at temperatures well below the combustion temperature of compositions described in this invention and would, therefore, be difficult to filter.

U.S. Pat. No. 4,931,112 entitled "Gas Generating Compositions Containing Nitrotriazalone" discloses the use of nitrotriazolone (NTO) in combination with nitrates and nitrites of alkali metals (except sodium) and the alkaline earth metals calcium, strontium or barium. However, the compositions taught in the patent are not capable of forming useful solid clinkers. For example, the two compositions given in Example 2 consist of different ratios of NTO and strontium nitrate which, upon combustion, would produce strontium oxide and strontium carbonate as fine dust since there is no low-temperature slag former present. Compositions claimed, utilizing mixtures of NTO and potassium nitrate, likewise will not form a useful solid clinker since potassium carbonate would be produced which would be a liquid at the combustion temperature and no high temperature slag former is present. The hydroxides mentioned are very unlikely to be formed because the excess carbon dioxide would convert the metal oxides to carbonates in preference to hydroxides. Even if some hydroxides were formed they would be the wrong type of slag former to promote clinker formation.

SUMMARY OF THE INVENTION

The primary advantage of a new nonazide gas generant composition in accordance with the instant invention is that solid combustion products are easily filtered from the gas produced. The nonazide gas generant uses tetrazoles or tetrazole salts as the fuel and nitrogen source. The unique feature of this invention is the novel use of oxidizers and additives resulting in solid combustion products which coalesce into easily filtered slag or clinkers.

Also, the gas generant compositions comprising this invention provide a relatively high yield of gas (moles of gas per gram of gas generant) compared to conventional occupant restraint gas generants.

DETAILED DESCRIPTION OF THE PREFERRED EMBODIMENT OF THE INVENTION

Since the ability to rapidly produce inflation gas which is relatively free of solid particulate matter is a requirement for automobile occupant restraint systems, even relatively nontoxic solids must be reduced to low levels. Almost any gas-solid mixture can be filtered to produce clean gas if a large expensive filter can be used. However, for automobile occupant restraint systems both filter size and cost must be minimized. The best way to accomplish this end is to produce solid combustion products which coalesce into large, easily filtered "clinkers" or slag.

Many combinations of ingredients can be used to improve the filtering characteristics of the combustion products. For most practical applications, however, compromises are necessary to provide the desired combination of slag forming ability, burn rate, gas production, gas quality, pellet forming characteristics, and other processing factors.

In accordance with the instant invention, several combinations of materials have been found which, produce easily filtered solid products as well as gases useful for inflation purposes. Such materials may be categorized as fuels, oxidizers, high-temperature slag formers and low-temperature slag formers. It is important that at least one material identified with each category be included in the mixture although certain materials can serve more than one of the categories as described below.

In formulating a fuel for the gas generant of an automobile occupant restraint system, it is desirable to maximize the nitrogen content of the fuel and regulate the carbon and hydrogen content thereof to moderate values. Although carbon and hydrogen may be oxidized to carbon dioxide and water, which are relatively nontoxic gases, large amounts of heat are generated in the process.

Tetrazole compounds such as aminotetrazole, tetrazole, bitetrazole and metal salts of these compounds, as well as triazole compounds such as 1,2,4-triazole-5-one or 3-nitro 1,2,4-triazole-5-one and metal salts of these compounds are especially useful fuels.

It should be noted that certain metal salts (alkaline earth metals) of these compounds can function, at least in part, as high temperature slag formers. For example, the calcium salt of tetrazole or bitetrazole forms, upon combustion, calcium oxide which would function as a high-temperature slag former. Magnesium, strontium, barium and possibly cerium salts would act in similar manner. In combination with a low-temperature slag former, a filterable slag would be formed. The alkali metal salts (lithium, sodium, potassium) could be considered, at least in part, as low-temperature slag formers since they could yield lower melting silicates or carbonates upon combustion.

Oxidizers generally supply all or most of the oxygen present in the system. In addition, however, they are the preferred method of including a high-temperature slag former into the reaction system. The alkaline earth and cerium nitrates are all oxidizers with high-temperature slag forming potential, although most of these salts are hygroscopic and are difficult to use effectively. Strontium and barium nitrates are easy to obtain in the anhydrous state and are excellent oxidizers. Alkali metal nitrates, chlorates and perchlorates are other useful oxidizers when combined with a high-temperature slag former.

Materials which function as high-temperature slag formers have melting points at, or higher, than the combustion temperature or decompose into compounds which have melting points, at or higher, than the combustion temperature. The alkaline earth oxides, hydroxides and oxalates are useful high-temperature slag formers. Magnesium carbonate and magnesium hydroxide are very useful high-temperature slag formers because they decompose before melting to form magnesium oxide which has a very high melting point (2800° C.). As mentioned above, oxidizers such as strontium nitrate are especially beneficial since they serve both as high-temperature slag former and oxidizer, thereby increasing the amount of gas produced per unit weight.

Metal salts as fuels, such as the calcium or strontium salt of 5-aminotetrazole, tetrazole, or ditetrazole are also useful high-temperature slag formers, although not as efficient as the oxidizers.

Other metal oxides having high melting points such as the oxides of titanium, zirconium and cerium are also useful high-temperature slag formers.

Materials which function as low-temperature slag formers have melting points at or below the combustion temperature or form compounds during combustion which have melting points at or below the combustion temperature. Compounds such as silicon dioxide ($SiO_2$), boric oxide ($B_2O_3$), vanadium pentoxide ($V_2O_5$), sodium silicate ($Na_2SiO_3$), potassium silicate ($K_2SiO_3$), sodium carbonate ($Na_2CO_3$) and potassium carbonate ($K_2CO_3$) are examples of low-temperature slag formers.

It should be noted that either the oxidizer or the fuel can act as a low-temperature slag former if it contains a suitable substance which can be converted during combustion. For example, sodium nitrate or the sodium salt of tetrazole, during the combustion reactions, can convert to sodium carbonate or sodium silicate, if silicon dioxide is also present.

It is desirable to combine the fuel or oxidizer (or both) and the high temperature slag former into one ingredient, as shown in Example 1, where the strontium nitrate serves as both the oxidizer and high-temperature slag former. In this case, the strontium nitrate will yield, upon combustion, strontium oxide (SrO), which has a high melting point (2430° C.) as well as oxygen and nitrogen gases. Silicon dioxide, used as a low-temperature slag former is available in many forms ranging from very fine submicron particles to coarse ground sand with melting points from about 1500° to 1700° C. The combination of strontium oxide and silicon dioxide forms strontium silicate ($SrSiO_3$) with a melting point of approximately 1580° C.

$$SrO + SiO_2 \rightarrow SrSiO_3$$

Strontium oxide can also react with carbon dioxide, forming strontium carbonate which melts at approximately 1500° C. at high pressure.

$$SrO + CO_2 \rightarrow SrCO_3$$

The extent of each of these reactions depends upon various conditions such as combustion temperature, pressure, particle size of each component, and the contact time between the various materials.

It is believed that the function of the low-temperature slag former is to melt and glue the high-temperature solid particles together. With only low-temperature residue, the material is liquid and is difficult to filter. With only high-temperature materials, finely divided particles are formed which are also difficult to filter. The objective is to produce just enough low-temperature material to induce a coherent mass or slag to form, but not enough to make a low viscosity liquid.

Set in the above context, the pyrotechnic, slag forming gas generating mixture of the present invention comprises at least one each of the following materials.

a. A fuel selected from the group of tetrazole compounds consisting of aminotetrazole, tetrazole, bitetrazole and metal salts of these compounds as well as triazole compounds and metal salts of triazole compounds.
b. An oxygen containing oxidizer compound selected from the group consisting of alkali metal, alkaline earth metal, lanthanide and ammonium nitrates and perchlorates or from the group consisting of alkali metal or alkaline earth metal chlorates or peroxides.
c. A high temperature slag forming material selected from the group consisting of alkaline earth metal or transition metal oxides, hydroxides, carbonates, oxalates, peroxides, nitrates, chlorates and perchlorates or from the group consisting of alkaline earth metal salts of tetrazoles, bitetrazoles and triazoles.
d. A low-temperature slag forming material selected from the group consisting of silicon dioxide, boric oxide and vanadium pentoxide or from the group consisting of alkali metal silicates, borates, carbonates, nitrates, perchlorates or chlorates or from the group consisting of alkali metal salts of tetrazoles, bitetrazoles and triazoles or from the group consisting of the various naturally occurring clays and talcs.

In practice, certain of the materials may be substituted or interchanged. Specifically, both the fuel and the high-temperature slag forming material may be selected from the group consisting of alkaline earth metal salts of tetrazoles, bitetrazoles and triazoles. Both the oxygen containing oxidizer compound and high-temperature slag forming material may be comprised of one or more of the group consisting of alkaline earth metal and lanthanide nitrates, perchlorates, chlorates and peroxides. Both the fuel and the low-temperature slag forming material may comprise one or more of the group consisting of alkali metal salts of tetrazoles, bitetrazoles and triazoles. Both the oxygen containing oxidizer compound and the low-temperature slag forming material may comprise one or more of the group consisting of alkali metal nitrates, perchlorates, chlorates and peroxides.

The fuel may comprise 5-aminotetrazole which is present in a concentration of about 22 to about 36% by weight, where the oxygen containing oxidizer compound and high-temperature slag former is strontium nitrate which is present in a concentration of about 38 to about 62% by weight, and said low-temperature slag former is silicon dioxide which is present in a concentration of about 2 to about 18% by weight.

Alternatively, the fuel and high-temperature slag forming material may comprise the strontium salt of 5-aminotetrazole which is present in a concentration of about 30 to about 50% by weight, where the oxygen containing oxidizer compound is potassium nitrate which is present in a concentration of about 40 to about 60% by weight, and the low-temperature slag former is talc which is present in a concentration of about 2 to about 10% by weight. The talc may be replaced by clay.

Another combination comprises the 5-aminotetrazole which is present in a combination of about 22 to about 36% by weight, where the oxygen containing oxidizer compound is sodium nitrate which is present in a concentration of about 30 to about 50% by weight, the high-temperature slag forming material is magnesium carbonate which is present in a concentration of about 8 to about 30% by weight, and the low-temperature slag former is silicon dioxide which is present in a concentration of about 2 to about 20% by weight. Magnesium carbonate may be replaced by magnesium hydroxide.

Yet another combination comprises the potassium salt of 5-aminotetrazole which is present in a concentration of about 2 to about 30% by weight which serves in part as a fuel and in part as a low-temperature slag former and wherein 5-aminotetraozle in a concentration of about 8 to about 40% by weight also serves as a fuel, and wherein clay in a concentration of about 2 to about 10% by weight serves in part as the low-temperature slag former and wherein strontium nitrate in a concentration of about 40 to about 66% by weight serves as both the oxygen containing oxidizer and high-temperature slag former.

EXAMPLE 1

A mixture of 5-aminotetrazole (5AT) strontium nitrate and silicon dioxide (silica) was prepared having the following composition in percent by weight: 33.1% 5AT, 58.9% strontium nitrate and 8% silica (Hi-sil 233). These powders were dry blended and pellets were prepared by compression molding. When ignited with a propane-oxygen torch, these pellets burned rapidly and left a coherent, well formed, solid residue.

EXAMPLE 2

A mixture of 5AT, strontium nitrate and bentonite clay was prepared having the following composition in percent by weight: 33.1% 5AT, 58.9% strontium nitrate and 8% clay. These powders were prepared and tested as in Example 1 with essentially identical results.

EXAMPLE 3

A mixture of 5AT, strontium nitrate and boric oxide was prepared having the following composition in percent by weight: 33.1% 5AT, 58.9% strontium nitrate and 8% boric oxide ($B_2O_3$). These powders were dry blended and pellets were prepared by compression molding. When ignited with a propane-oxygen torch these pellets burned at a moderate rate and left a solid, partially porous residue.

EXAMPLE 4

A mixture of 5AT, sodium nitrate, iron oxide and silicon dioxide was prepared having the following composition in percent by weight: 26.7% 5AT, 39.3% sodium nitrate, 29.3% iron oxide ($Fe_2O_3$) and 4.7% silicon dioxide. The iron oxide used was Mapico Red 516 Dark and the silicon dioxide was Hi-sil 233. These powders were dry blended and pellets were formed by compression molding. When ignited with a propane-oxygen torch, the pellets burned smoothly leaving behind an expanded solid foam residue. When the pellets were burned in a Parr combustion bomb at an initial pressure of 25 atmospheres, a solid, coherent relatively hard residue was formed.

EXAMPLE 5

A mixture of 5AT, sodium nitrate, strontium nitrate and silicon dioxide was prepared having the following composition in percent by weight: 33.0% 5AT, 10.0% sodium nitrate, 49.0% strontium nitrate and 8.0% silicon dioxide (Hi-sil 233). These powders were dry-blended and pellets were formed by compression molding. When ignited with a propane-oxygen torch, the pellets burned rapidly and left a hard, solid residue.

The burning rate of this composition was found to be 0.70 inch per second at 1000 psi. The burning rate was determined by measuring the time required to burn a cylindrical pellet of known length. The pellets were compression molded in a ½-in. diameter die at approximately 16,000 pounds force, and were then coated on the sides with an epoxy/titanium dioxide inhibitor which prevented burning along the sides.

EXAMPLE 6

A mixture of 5AT, sodium nitrate, magnesium carbonate and silicon dioxide was prepared having the following composition in percent by weight: 29.6% 5AT, 40.4% sodium nitrate, 25.5% magnesium carbonate and 4.5% silicon dioxide. These powders were dry-blended and pellets were formed by compression molding. When ignited with a propane-oxygen torch, the pellets burned smoothly and left a solid, hard residue.

EXAMPLE 7

Example 8 was repeated except that magnesium hydroxide was substituted for magnesium carbonate. Pellets were prepared and burned with essentially identical results.

EXAMPLE 8

A mixture of 1,2,4-triazol-5-one (TO), strontium nitrate and silicon dioxide was prepared having the following composition in percent by weight: 27.6% TO, 64.4% strontium nitrate and 8.0% silicon dioxide (Hi-sil 233). These powders were dry-blended and pellets were formed by compression molding. When ignited with a propane-oxygen torch, the pellets burned smoothly and left a solid, partially porous residue.

Table I defines the role of the various ingredients and identifies approximate ranges (in weight percent) of each ingredient for the above examples.

TABLE 1

| Example No. | Reactants | High Temperature Slag Former | Low Temperature Slag Former | Probable Slag Components |
|---|---|---|---|---|
| 1. | 5AT(22-36)<br>$Sr(NO_3)_2$<br>$SiO_2$ | $Sr(NO_3)_2$<br>(38-62) | $SiO_2$<br>(2-18) | SrO<br>$SrCO_3$<br>$SrSiO_3$ |
| 2. | 5AT(22-36)<br>$Sr(NO_3)_2$<br>Clay | $Sr(NO_3)_2$<br>(38-62) | Clay<br>(2-18) | SrO<br>$SrCO_3$<br>$SrSiO_3$<br>Other silicates |
| 3. | 5AT(22-36)<br>$Sr(NO_3)_2$<br>$B_2O_3$ | $Sr(NO_3)_2$<br>(38-62) | $B_2O_3$<br>(2-18) | $SrB_2O_4$<br>$SrB_4O_7$<br>$SrCO_3$ |
| 4. | 5AT(22-30)<br>$NaNO_3$<br>$Fe_2O_3$<br>$SiO_2$ | $Fe_2O_3$(10-40) | $NaNO_3$(30-50)<br>$SiO_2$(2-20) | $Na_2SiO_3$<br>$Na_2CO_3$<br>$NaFeO_2$<br>$Fe_2O_3$<br>FeO |
| 5. | 5AT(22-36)<br>$NaNO_3$<br>$Sr(NO_3)_2$<br>$SiO_2$ | $Sr(NO_3)_2$(8-62) | $NaNO_3$(0-42)<br>$SiO_2$(2-20) | $Na_2SiO_3$<br>$Na_2CO_3$<br>SrO<br>$SrCO_3$<br>$SrSiO_3$ |
| 6. | 5AT(22-36)<br>$NaNO_3$<br>$MgCO_3$ | $MgCO_3$(8-30) | $NaNO_3$(30-50)<br>$SiO_2$(2-20) | $Na_2SiO_3$<br>$Na_2CO_3$<br>$MgSiO_3$ |

TABLE 1-continued

| Example No. | Reactants | High Temperature Slag Former | Low Temperature Slag Former | Probable Slag Components |
|---|---|---|---|---|
| | $SiO_2$ | | | MgO<br>$SiO_2$ |
| 7. | 5AT(22-36)<br>$NaNO_3$<br>$Mg(OH)_2$<br>$SiO_2$ | $Mg(OH)_2$(8-30) | $NaNO_3$(30-50)<br>$SiO_2$(2-20) | $MgSiO_3$<br>MgO<br>$SiO_2$ |
| 8. | TO(20-34)<br>$Sr(NO_3)_2$<br>$SiO_2$ | $Sr(NO_3)_2$<br>(40-78) | $SiO_2$<br>(2-20) | SrO<br>$SrCO_3$<br>$SrSiO_3$ |

While the preferred embodiment of the invention has been disclosed, it should be appreciated that the invention is susceptible of modification without departing from the scope of the following claims.

I claim:

1. A pyrotechnic, combustion filterable slag-particles forming gas generating mixture useful for inflating an automobile or aircraft safety crash bag, said pyrotechnic mixture comprising at least one material of each of the following functional groups of materials:

a. A fuel selected from the group of azole compounds consisting of triazole aminotetrazole, tetrazole, bitetrazole and metal salts of these compounds, b. An oxygen containing oxidizer compound selected from the group consisting of alkali metal, alkaline earth metal, lanthanide and ammonium nitrates and perchlorates or from the group consisting of alkali metal and alkaline earth metal chlorates and peroxides, c. A high temperature slag forming material selected from the group consisting of alkaline earth metal oxides, hydroxides, cabonates, and oxalates, d. A low-temperature slag forming material which is sufficient in amount during combustion to cause the solid combustion particles to coalesce into easily filterable slag or clinkers but not so much as to make a low viscosity liquid, selected from the group consisting of silicon dioxide, boric oxide and vanadium pentoxide or from the group consisting of alkali metal silicates, borates, and carbonates or from the group consisting of naturally occurring clays and talcs.

2. The composition of claim 1 wherein the fuel comprises 5-aminotetrazole which is present in a concentration of about 22 to about 36% by weight, said oxygen containing oxidizer compound comprises strontium nitrate which is present in a concentration of about 38 to about 62% by weight, and said low-temperature slag former is silicon dioxide which is present in a concentration of about 2 to about 18% by weight.

3. The composition of claim 1 wherein the fuel comprises the strontium salt of 5-aminotetrazole which is present in a concentration of about 30 to about 50% by weight, said oxygen containing oxidizer compound comprises potassium nitrate which is present in a concentration of about 40 to about 60% by weight and said low temperature slag former comprises talc which is present in a concentration of about 2 to about 10% by weight.

4. The composition of claim 1 wherein the fuel comprises 5-aminotetrazole which is present in a concentration of about 22 to about 36% by weight, said oxygen containing oxidizer compound comprises sodium nitrate which is present in a concentration of about 30 to about 50% by weight, said high-temperature slag forming material comprises magnesium carbonate which is present in a concentration of about 8 to about 30% by weight and said low-temperature slag former comprises silicon dioxide which is present in a concentration of about 2 to about 20% by weight.

5. The composition of claim 1 wherein the fuel compound comprises 5-aminotetrazole which is present in a concentration of about 22 to about 36% by weight, said oxygen containing oxidizer compound comprises sodium nitrate which is present in a concentration of about 30 to about 50% by weight, said high-temperature slag forming material comprises magnesium hydroxide which is present in a concentration of about 8 to about 30% by weight and said low-temperature slag former comprises silicon dioxide which is present in a concentration of about 2 to about 20% by weight.

6. The composition of claim 1 wherein the fuel comprises the strontium salt of 5-aminotetrazole which is present in a concentration of about 30 to about 50% by weight, said oxygen containing oxidizer compound comprises potassium nitrate which is present in a concentration of about 40 to about 60% by weight and said low temperature slag former comprises clay which is present in a concentration of about 2 to about 10% by weight.

7. The composition of claim 1 wherein the potassium salt of 5-aminotetrazole which is present in a concentration of about 2 to about 30% by weight serves in part as a fuel and in part as a low-temperature slag former and wherein 5-aminotetrazole in a concentration of about 8 to about 40% by weight also serves as a fuel, and wherein clay in a concentration of about 2 to about 10% by weight serves in part as the low-temperature slag former and wherein strontium nitrate in a concentration of about 40 to about 66% by weight serves as both the oxygen containing oxidizer and high-temperature slag former.

8. A slag forming gas generating composition for an inflatable occupant restraint system comprising a mixture of:

(a) about 22 to about 36 percent by weight of 5-aminotetrazole, (b) about 38 to about 62 percent by weight of strontium nitrate, and (c) about 2 to about 18 percent by weight of silicon dioxide.

9. A slag forming gas generating composition for an inflatable occupant restraint system comprising a mixture of:

(a) about 22 to about 36 percent by weight of 5-aminotetrazole, (b) about 38 to about 62 percent by weight of strontium nitrate, and (c) about 2 to about 18 percent by weight of clay.

10. A slag forming gas generating composition for an inflatable occupant restraint system comprising a mixture of:

(a) about 22 to about 36 percent by weight of 5-aminotetrazole,
(b) about 38 to about 62 percent by weight of strontium nitrate, and
(c) about 2 to about 18 percent by weight of boric acid.

11. A slag forming gas generating composition for an inflatable occupant restraint system comprising a mixture of:

(a) about 22 to about 30 percent by weight of 5-aminotetrazole,
(b) about 10 to about 40 percent by weight of iron oxide,
(c) about 30 to about 50 percent by weight of sodium nitrate, and
(d) about 2 to about 20 percent by weight of silicon dioxide.

12. A slag forming gas generating composition for an inflatable occupant restraint system comprising a mixture of:

(a) about 22 to about 36 percent by weight of 5-aminotetrazole,
(b) about 8 to about 62 percent by weight of strontium nitrate,
(c) about 0 to about 42 percent by weight of sodium nitrate, and
(d) about 2 to about 18 percent by weight of silicon dioxide.

13. A slag forming gas generating composition for an inflatable occupant restraint system comprising a mixture of:

(a) about 22 to about 36 percent by weight of 5-aminotetrazole,
(b) about 30 to about 50 percent by weight of sodium nitrate,
(c) about 8 to about 30 percent by weight of magnesium carbonate, and
(d) about 2 to about 20 percent by weight of silicon dioxide.

14. A slag forming gas generating composition for an inflatable occupant restraint system comprising a mixture of:

(a) about 22 to about 36 percent by weight of 5-aminotetrazole,
(b) about 30 to about 50 percent by weight of sodium nitrate,
(c) about 8 to about 30 percent by weight of magnesium hydroxide, and
(d) about 2 to about 20 percent by weight of silicon dioxide.

15. A slag forming gas generating composition for an inflatable occupant restraint system comprising a mixture of:

(a) about 20 to about 34 percent by weight of 1,2,4-triazole-5-one,
(b) about 40 to about 78 percent by weight of strontium nitrate, and
(c) about 2 to about 20 percent by weight of silicon dioxide.

* * * * *